US009325050B2

(12) United States Patent
Gao et al.

(10) Patent No.: US 9,325,050 B2
(45) Date of Patent: Apr. 26, 2016

(54) COMPACT MICROSTRIP TO WAVEGUIDE DUAL COUPLER TRANSITION WITH A TRANSITION PROBE AND FIRST AND SECOND COUPLER PROBES

(71) Applicant: ZTE (USA) Inc., Richardson, TX (US)

(72) Inventors: Peng Gao, Xian (CN); Ying Shen, Chapel Hill, NC (US)

(73) Assignee: ZTE (USA) INC., Austin, TX (US)

( * ) Notice: Subject to any disclaimer, the term of this patent is extended or adjusted under 35 U.S.C. 154(b) by 0 days.

(21) Appl. No.: 14/076,093

(22) Filed: Nov. 8, 2013

(65) Prior Publication Data

US 2014/0125425 A1 May 8, 2014

Related U.S. Application Data

(60) Provisional application No. 61/724,183, filed on Nov. 8, 2012.

(51) Int. Cl.

| | |
|---|---|
| ***H01P 5/107*** | (2006.01) |
| ***H01P 5/08*** | (2006.01) |
| ***H01P 5/12*** | (2006.01) |
| *H01P 5/02* | (2006.01) |

(52) U.S. Cl.
CPC *H01P 5/107* (2013.01); *H01P 5/08* (2013.01); *H01P 5/12* (2013.01); *H01P 5/028* (2013.01)

(58) Field of Classification Search
CPC ..... H01P 5/107; H01P 5/12
USPC ..... 333/26, 125
See application file for complete search history.

(56) References Cited

U.S. PATENT DOCUMENTS

| | | | | |
|---|---|---|---|---|
| 6,967,543 | B2 * | 11/2005 | Ammar | 333/26 |
| 2010/0225410 | A1 * | 9/2010 | Margomenos et al. | 333/26 |
| 2010/0231332 | A1 * | 9/2010 | Sugimoto et al. | 333/254 |

* cited by examiner

*Primary Examiner* — Benny Lee
(74) *Attorney, Agent, or Firm* — Morgan, Lewis & Bockius LLP

(57) ABSTRACT

A compact microstrip to waveguide dual coupler transition includes a multilayer printed circuit board configured with a rectangular region on an upper surface of the multilayer printed circuit board, wherein the rectangular region has a pair of long edges and a pair of short edges; a transition probe configured on the upper surface of the multilayer printed circuit board, wherein a terminal of the transition probe extends into the rectangular region through a long edge of the rectangular region, and another terminal of the transition probe is electrically connected to a power amplifier; a first coupler probe configured on the upper surface of the multilayer printed circuit board, wherein a terminal of the first coupler probe extends into the rectangular region; and a second coupler probe configured on the upper surface of the multilayer printed circuit board, wherein a terminal of the second coupler probe extends into the rectangular region.

14 Claims, 15 Drawing Sheets

COMPACT MICROSTRIP TO WAVEGUIDE DUAL COUPLER TRANSITION WITH A TRANSITION PROBE AND FIRST AND SECOND COUPLER PROBES

RELATED APPLICATION

This application claims priority to U.S. Provisional Patent Application No. 61/724,183, "COMPACT MICROSTRIP TO WAVEGUIDE DUAL COUPLER TRANSITION," filed on Nov. 8, 2012, which is hereby incorporated by reference in its entirety.

TECHNICAL FIELD

The present invention relates to wireless communication system and wireless communication equipment, and in particular, relates to a compact microstrip to waveguide dual coupler transition.

BACKGROUND

Modern microwave transmitter generally require an accurate control of the radio frequency (RF) transmit power. In the wireless applications, automatic power level control, dynamic power control over various distances and accurate power level control to avoid excessive power to adjacent cells are a few examples of the importance of accurate power controls. FIG. 1A is an example of a conventional power detector application to achieve an accurate control of the transmitted power.

In addition to the accurate output power control in modern wireless transmitter, current advanced RF/microwave transmitters incorporate pre-distortion techniques or similar techniques to increase the output power, reduce system power consumption and increase power efficiency. Because of the low cost advantage and the implementation of digital signal processing, linearization of a power amplifier has become an important technology. Nearly all pre-distortion techniques require that a coupled RF signal at the output of the power amplifier be processed and corrected through digital or analog techniques. FIG. 1B illustrates an example of a conventional pre-distortion linearization application in current wireless system.

Further, an RF loopback is another important system requirement. The RF loopback is designed for system self-debug and calibration applications in current RF/microwave system. The RF loopback provides the system an internal RF path from the output of the transmitter to the local receiver input. With the feature of the RF loopback, the end-to-end test can be easily performed to test system calibration, or on-site system self-debug to minimize the cost related to product manufacturing, installation and field maintenance. FIG. 2A illustrates an example of a conventional RF loopback application in current wireless system.

Further, coherent power combining is another example of a system level RF coupler. To achieve maximum RF output power with the maximum efficiency, coherent power combining is used, and becomes one of the most efficient power combining methods. For example, in a phase RF power combining application, each transmitter has respective calibrated phase input signal, and each RF coupler of a transmitter is configured with a phase detector and adjusting feature. FIG. 2B illustrates an example of a conventional coherent power combing application in current wireless system.

To achieve some or all of the above advanced features, an RF transmitter needs to either have one RF coupler and split configuration as shown in FIG. 3A, or a dual RF coupler and split configuration as shown in FIG. 3B. In microwave and millimeter wave bands above 10 GHz, the output port is usually a waveguide due to its minimum transmission loss and optimum connection to the antenna. Microstrip is the most common used transmission technique due to easy manufacturing and low cost. FIG. 4 is an example of a compact microstrip to waveguide dual coupler transition, as described in the earlier patent application 61/673,161 "A Compact Low Loss Transition with an Integrated Coupler," which is hereby incorporated by reference in its entirety.

SUMMARY OF THE INVENTION

In accordance with some embodiments, a compact microstrip to waveguide dual coupler transition comprises a multilayer printed circuit board configured with a rectangular region on an upper surface of the multilayer printed circuit board, wherein the rectangular region has a pair of long edges and a pair of short edges; a transition probe configured on the upper surface of the multilayer printed circuit board, wherein a terminal of the transition probe extends into the rectangular region through a long edge of the rectangular region, and another terminal of the transition probe is electrically connected to a power amplifier; a first coupler probe configured on the upper surface of the multilayer printed circuit board, wherein a terminal of the first coupler probe extends into the rectangular region; and a second coupler probe configured on the upper surface of the multilayer printed circuit board, wherein a terminal of the second coupler probe extends into the rectangular region.

In accordance with some embodiments, the first coupler probe extends into the rectangular region through a short edge of the rectangular region, and the second coupler extends into the rectangular region through the same long edge of the rectangular region as the transition probe.

In accordance with some embodiments, the first coupler probe extends into the rectangular region through the same long edge of the rectangular region as the transition probe, and disposed at one side of the transition probe; and the second coupler probe extends into the rectangular region through the same long edge of the rectangular region as the transition probe, and disposed at another side of the transition probe.

In accordance with some embodiments, the first coupler probe extends into the rectangular region through an opposite long edge of the rectangular region from the transition probe, and the second coupler probe extends into the rectangular region through the opposite long edge of the rectangular region from the transition probe.

In accordance with some embodiments, the first coupler probe extends into the rectangular region through an opposite long edge of the rectangular region from the transition probe; and the second coupler probe extends into the rectangular region through the same long edge of the rectangular region as the transition probe.

In accordance with some embodiments, the first coupler probe extends into the rectangular region through a short edge of the rectangular region; and the second coupler probe extends into the rectangular region through an opposite short edge of the rectangular region from the first coupler probe.

In accordance with some embodiments, the terminal of the coupler probe has a shape selected from the group consisting of rectangle, fan, ring, and stub.

In accordance with some embodiments, a waveguide is propagated through the rectangle region of the upper surface of the multilayer printed circuit board in a direction perpendicular to the upper surface of the multilayer printed circuit board.

In accordance with some embodiments, an input radio frequency (RF) signal is inputted through the transition probe in a direction parallel to the upper surface of the multilayer printed circuit board.

In accordance with some embodiments, a first output RF signal is outputted through the first coupler probe in a direction parallel to the upper surface of the multilayer printed circuit board, and a second output RF signal is outputted through the second coupler probe in a direction parallel to the upper surface of the multilayer printed circuit board.

In accordance with some embodiments, the rectangular region on the upper surface of the printed circuit board is devoid of metal layer.

In accordance with some embodiments, a bottom surface of the multilayer printed circuit board is connected to a waveguide back short.

In accordance with some embodiments, the terminal of the transition probe is electrically coupled to an internal space of the waveguide through an electric field.

In accordance with some embodiments, the terminal of the first coupler probe and the terminal of the second coupler probe are magnetically coupled to an internal of space the waveguide through a magnetic field.

In accordance with some embodiments, the rectangular region on the upper surface of the printed circuit board is surrounded by a plurality of metal-plated through-hole vias plated from the upper surface to the bottom surface through the multilayer printed circuit board.

In accordance with some embodiments, the rectangular region on the upper surface of the printed circuit board is surrounded by a plurality of metal-plated slots plated from the upper surface to the bottom surface through the multilayer printed circuit board.

In accordance with some embodiments, the metal-plated slots are disposed adjacent to the transition probe.

In accordance with some embodiments, the metal-plated slots are disposed adjacent to the first coupler probe.

In accordance with some embodiments, the metal-plated slots are disposed adjacent to the second coupler probe.

BRIEF DESCRIPTION OF THE DRAWINGS

Different aspects of the present invention as well as features and advantages thereof will be more clearly understood hereinafter because of a detailed description of embodiments of the present invention when taken in conjunction with the accompanying drawings, which are not necessarily drawn to scale. Like reference numerals refer to corresponding parts throughout the several views of the drawings.

DETAILED DESCRIPTION OF PREFERRED EMBODIMENTS

Reference will now be made in detail to embodiments, examples of which are illustrated in the accompanying drawings. In the following detailed description, numerous non-limiting specific details are set forth in order to assist in understanding the subject matter presented herein. It will be apparent, however, to one of ordinary skill in the art that various alternatives may be used without departing from the scope of the present invention and the subject matter may be practiced without these specific details. For example, it will be apparent to one of ordinary skill in the art that the subject matter presented herein can be implemented on many types of outdoor radios systems.

Figure 1A:
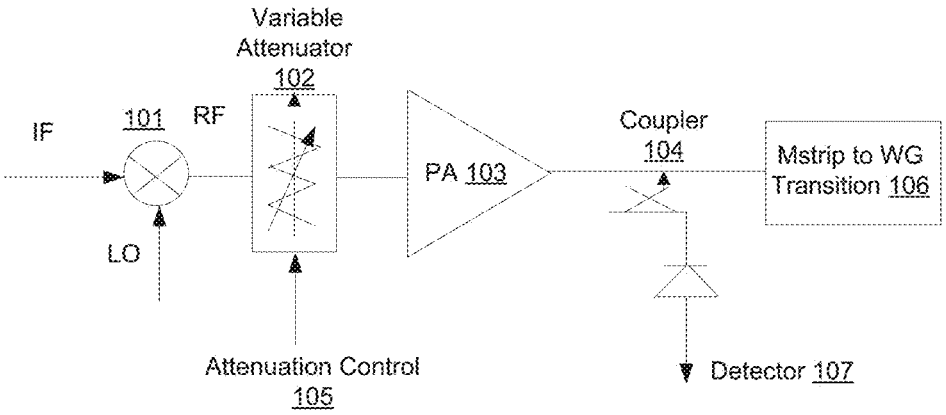
PRIOR ART FIG. 1A
FIG. 1A depicts a structure of a conventional power detector application.

FIG. 1A depicts a structure of a conventional power detector application that includes a frequency mixer 101, a variable attenuator 102, a power amplifier 103 (PA), a coupler 104, and a microstrip to waveguide transition 106. The coupler 104 further includes a detector 107. The frequency mixer 101 receives an intermediate frequency (IF) signal and a local oscillation (LO), and outputs a radio frequency (RF) signal to the variable attenuator 102. With the attenuation control signal 105, the variable attenuator 102 outputs the RF signal to the coupler to be transmitted to the transition 106.

Figure 1B:
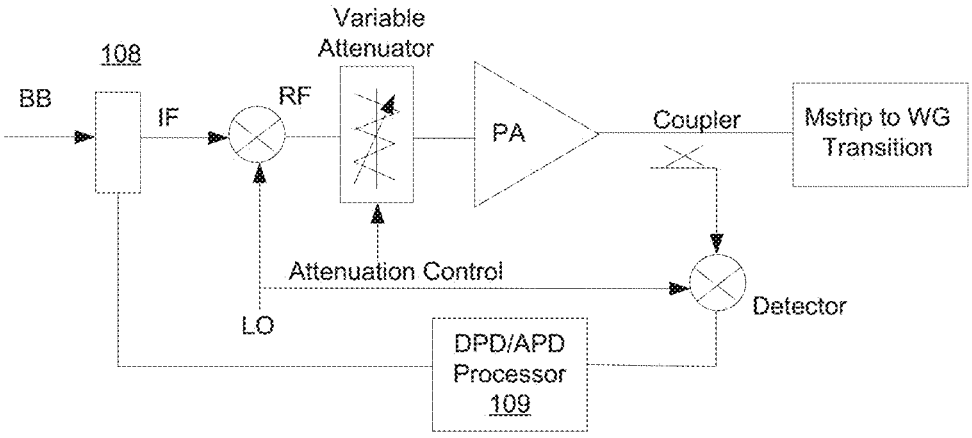
PRIOR ART FIG. 1B
FIG. 1B depicts a structure of a conventional pre-distortion linearization application.

FIG. 1B depicts a structure of a conventional pre-distortion linearization application. In addition to the electric elements shown in FIG. 1A, the conventional pre-distortion linearization application further includes a baseband (BB) signal processor 108 that converts the BB signal into an IF signal, and a digital pre-distortion/analog pre-distortion (DPD/APD) processor 109 to perform digital/analog frequency signal conversion.

Figure 2A:
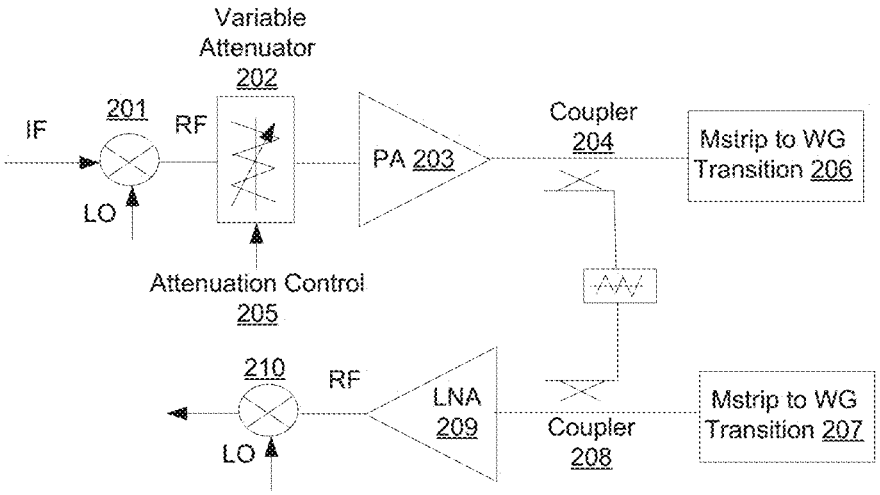
PRIOR ART FIG. 2A
FIG. 2A depicts a structure of a conventional RF loopback application.

FIG. 2A depicts a structure of a conventional RF loopback application that includes a first frequency mixer 201, a variable attenuator 202, a PA 203, a first coupler 204, a first microstrip to waveguide transition 206, a second microstrip to waveguide transition 207, a second coupler 208, a low noise amplifier (LNA) 209, and a second frequency mixer 210. At the transmitter end, the first frequency mixer 201 receives an IF signal and an LO signal, and outputs an RF signal to the variable attenuator 202. With the attenuation control signal 205, the variable attenuator 202 outputs the RF signal to the first coupler 204 to be transmitted to the first microstrip to waveguide transition 206. At the receiver end, the second coupler 208 receives the RF signal that is coupled through the first coupler 204, and transmits to LNA 209. The LNA 209 amplifies the RF signal and outputs the RF signal to the second frequency mixer 210. Such RF loopback application provides an internal RF path from the output of the transmitter to the input of the receiver.

Figure 2B:
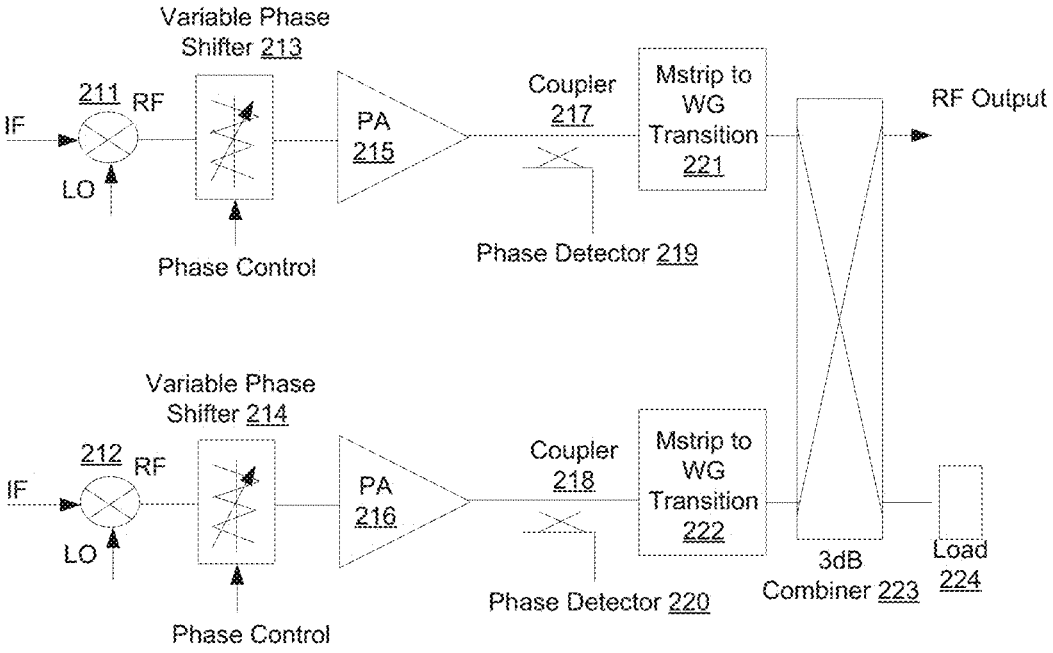
PRIOR ART FIG. 2B
FIG. 2B depicts a structure of a conventional coherent power combining application.

FIG. 2B depicts a structure of a conventional coherent power combining application that includes a pair of frequency mixer 211, 212, a pair of variable phase shifter 213, 214, a pair of PA 215, 216, a pair of couplers 217, 218, a pair of microstrip to waveguide transition 221, 222, a 3 dB combiner 223, and a load 224. In each transmitter, the frequency mixer 211/212 receives an IF signal and an LO signal, and outputs an RF signal to the variable phase shifter 213/214. With a respective phase control signal, the variable phase shifter 213/214 outputs an RF signal to the coupler 217/218 to be transmitted to the microstrip to waveguide transition 221/222. The coupled RF signal from the coupler 217/218 is transmitted to the phase detector 219/220, and thus closing the loop with the input signal of variable phase shifter 213/214 to achieve constant phase control of the RF signal. The output signals from the microstrip to waveguide transition 221 and 222 are combined by the 3 dB combiner 223 with a load 224, and generates one RF output signal.

Figure 3A:
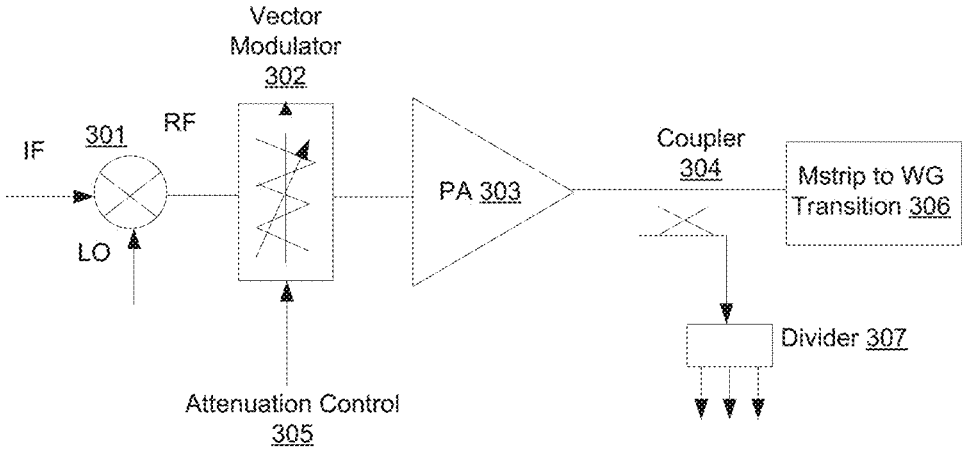
PRIOR ART FIG. 3A
FIGS. 3A depict a structure of a conventional single RF coupler with split configuration.

FIGS. 3A depict a structure of a conventional single RF coupler with split configuration that includes a frequency mixer 301, a vector modulator 302, a PA 303, a coupler 304, and a microstrip to waveguide transition 306. The coupler 304 further includes a divider 307. The frequency mixer 301 receives an IF signal and an LO signal, and outputs an RF signal to the vector modulator 302. With the attenuation control signal 305, the vector modulator 302 outputs an RF signal to the coupler 304 to be transmitted to the transition 306. The coupled RF signal from the coupler 304 is further distributed through the divider 307.

Figure 3B:
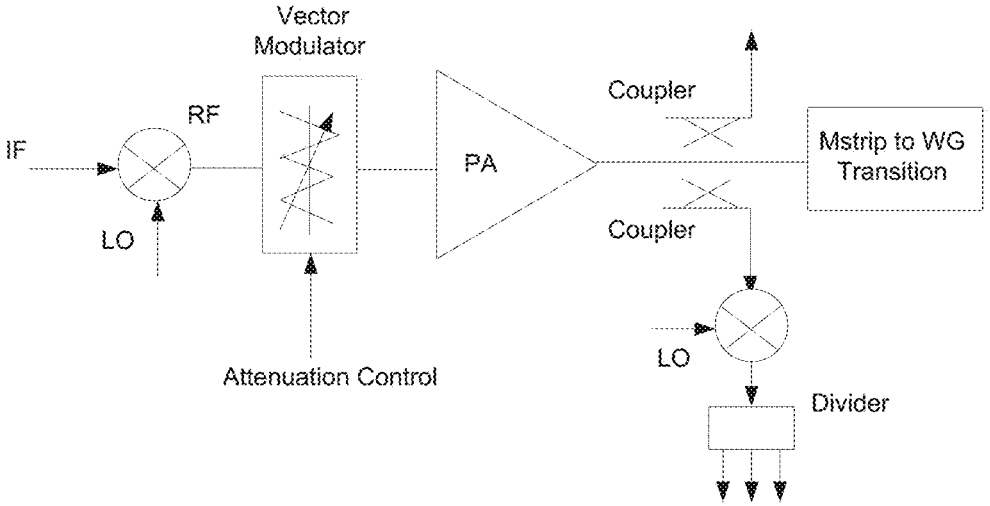
PRIOR ART FIG. 3B
FIGS. 3B depict a structure of a conventional dual RF coupler with split configuration.

FIGS. 3B depict a structure of a conventional dual RF coupler with split configuration. In addition to the electric elements shown in FIG. 3A, the conventional dual RF coupler with split configuration includes a second coupler to couple the transmitted RF signal.

Figure 4:
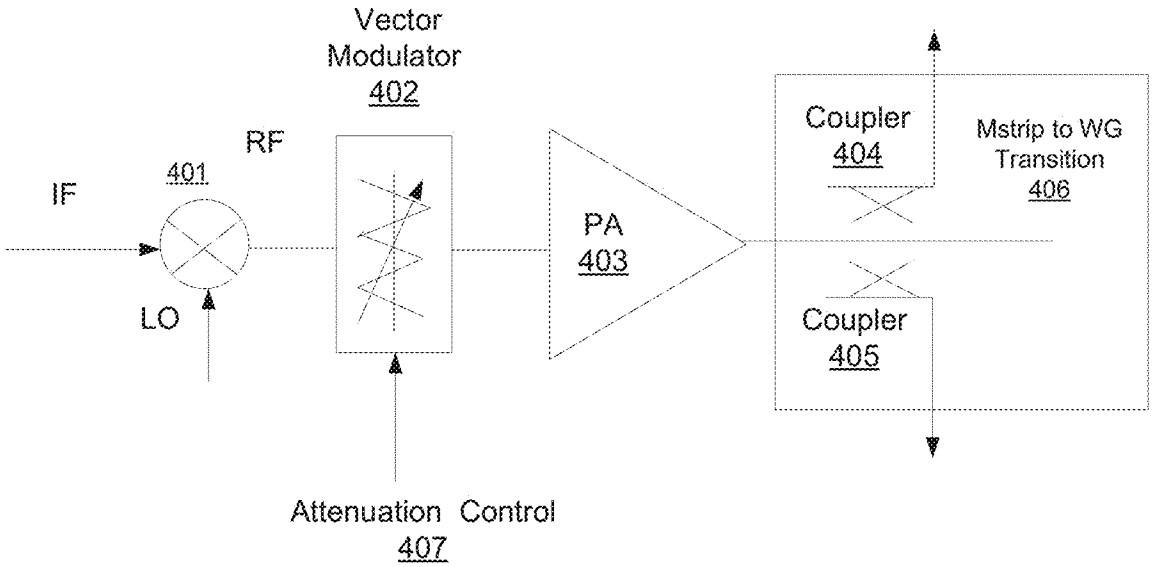
FIG. 4 depicts a structure of a power detector application configured with a compact microstrip to waveguide dual coupler transition in accordance with some embodiments of the present invention.

FIG. 4 depicts a structure of a power detector application configured with a compact microstrip to waveguide dual coupler transition in accordance with some embodiments of the present invention that includes a frequency mixer 401, a vector modulator 402 having an attenuation control 407,a PA 403, a pair of couplers 404, 405 and a microstrip to waveguide transition 406. As illustrated in FIG. 4, the pair of couplers 404, 405 and the microstrip to waveguide transition 406 are no longer separate devices. Instead, they are integrated together as one compact device.

Figure 5:
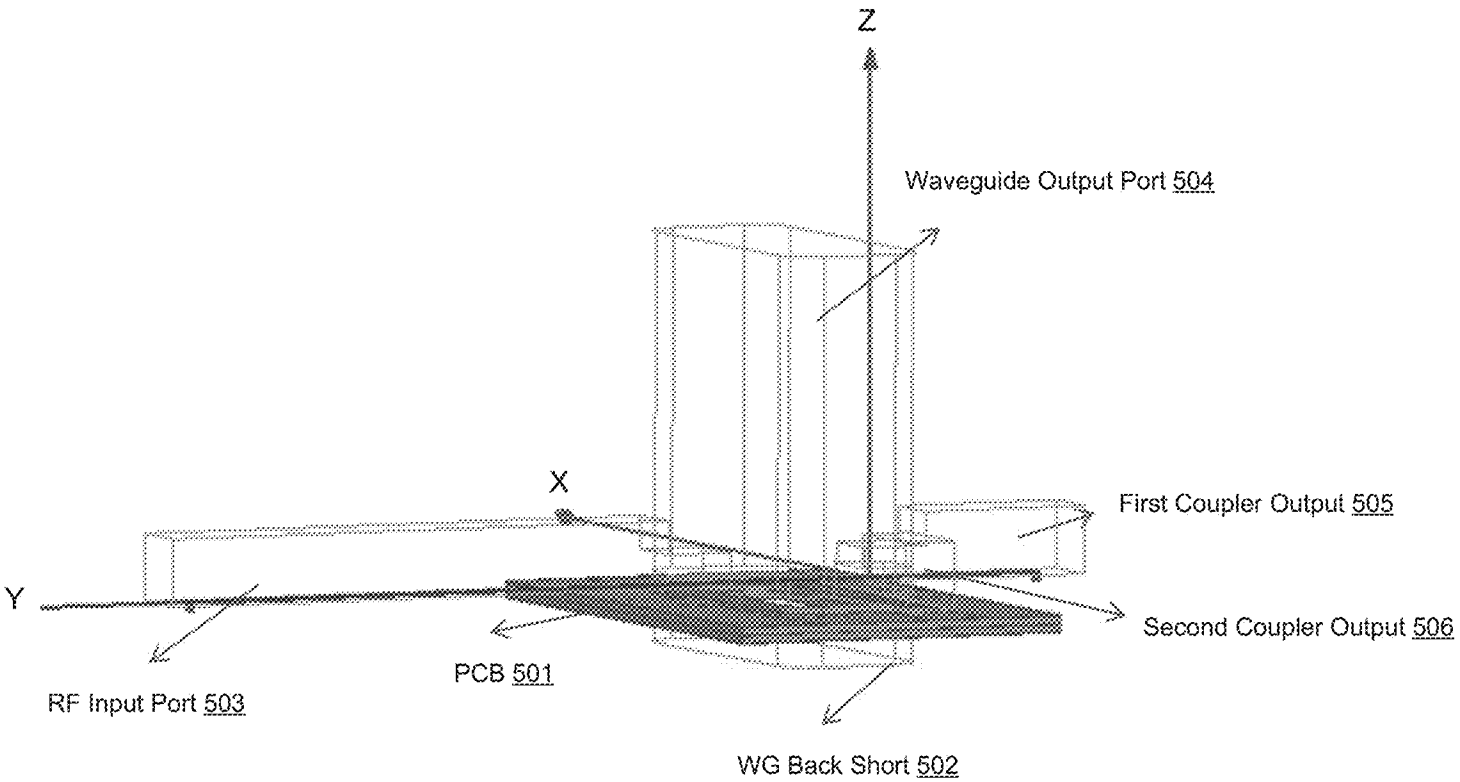
FIG. 5 depicts an example of a compact microstrip to waveguide dual coupler in accordance with some embodiments of the present invention.

FIG. 5 depicts an example of a compact microstrip to waveguide dual coupler in a 3-D coordinate system defined by (X,Y,Z) in accordance with some embodiments of the present invention. The compact microstrip to waveguide dual coupler includes a multilayer printed circuit board (PCB) 501, a waveguide back short 502 that is connected to a bottom surface of the PCB 501, an RF input port 503 parallel to an upper surface of the PCB 501, a waveguide output port 504 perpendicular to the upper surface of the PCB 501, a first coupler output port 505 parallel to the upper surface of the PCB 501, and a second coupler output port 506 parallel to the upper surface of the PCB 501. A waveguide is propagated through the waveguide output port 504. In some embodiment of the present invention, the first coupler output port 505 is parallel to the second coupler output port 506. In yet another embodiment of the present invention, the first coupler output port 505 is perpendicular to the second coupler output port 506.

Figure 6:
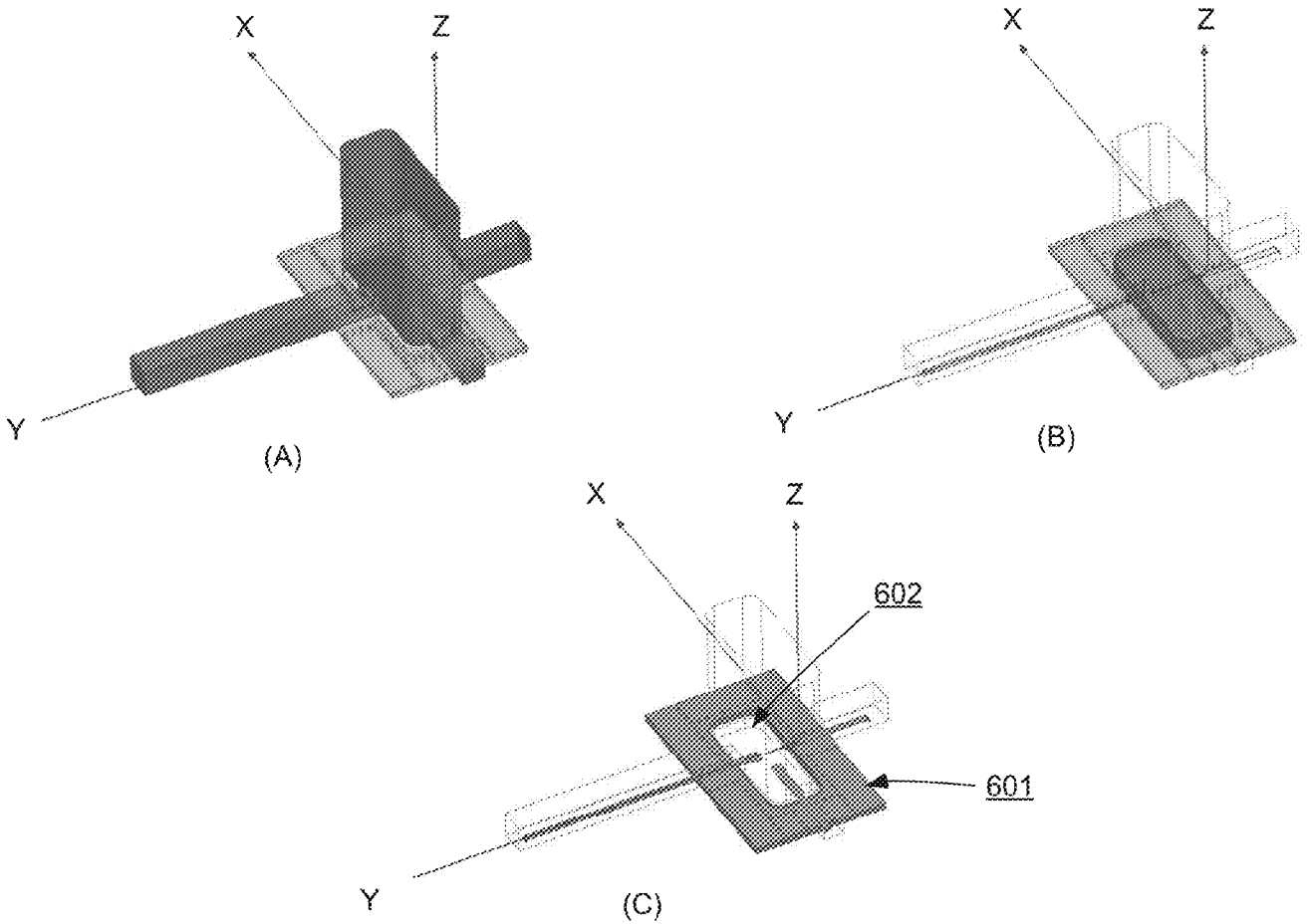
FIG. 6 depicts a top view of a compact microstrip to waveguide dual coupler in accordance with some embodiments of the present invention.

FIGs. 6A to 6C depict a top view of a compact microstrip to waveguide dual coupler in a 3-D coordinate system defined by (X,Y,Z) in accordance with some embodiments of the present invention. Note that FIG.6A includes the input and output ports whereas FIGS.6B and 6C do not. A top view of the compact microstrip to waveguide dual coupler, as illustrated in FIG. 6C, shows that PCB 601 is configured with a rectangular region 602 on the upper surface of PCB 601, where the rectangular region has a pair of long edges and a pair of short edges. Further, the rectangular region 602 on the upper surface of the PCB 601 is devoid of metal layer.

Figure 7A:
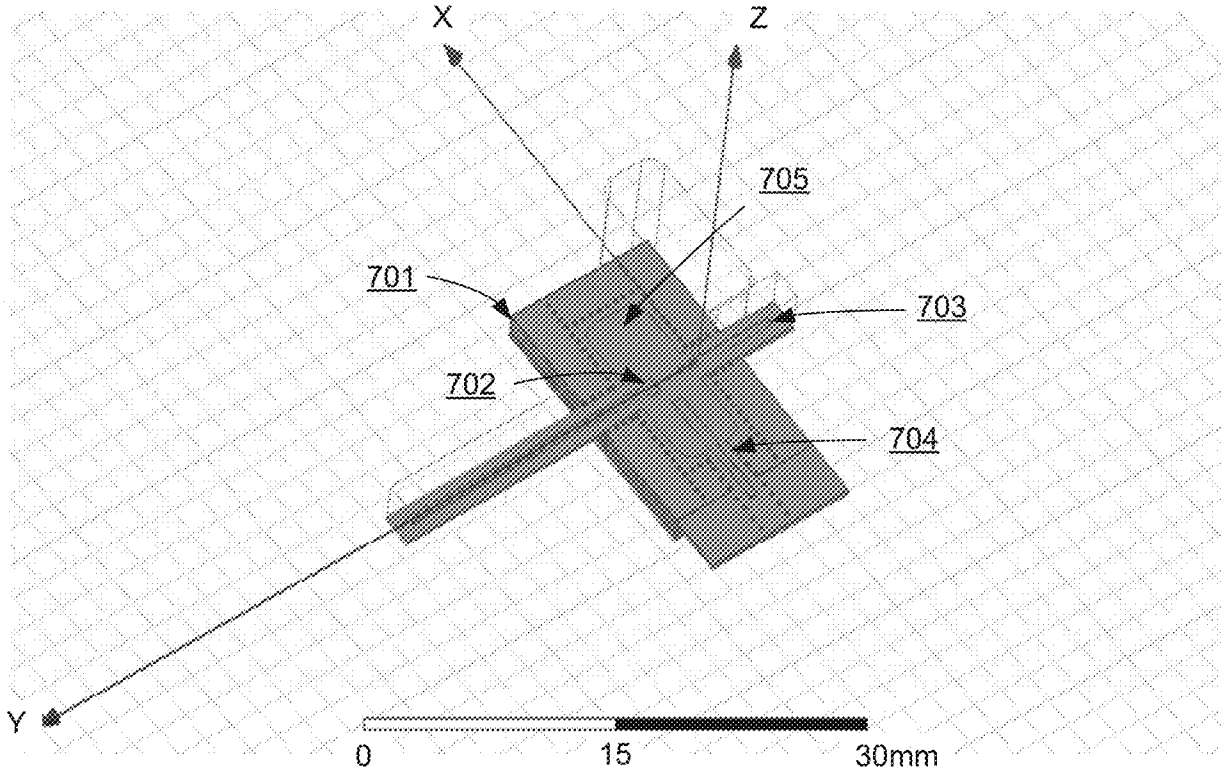
FIGS. 7A to 7C depict three examples of a compact microstrip to waveguide dual coupler in accordance with some embodiments of the present invention.
Figure 7B:
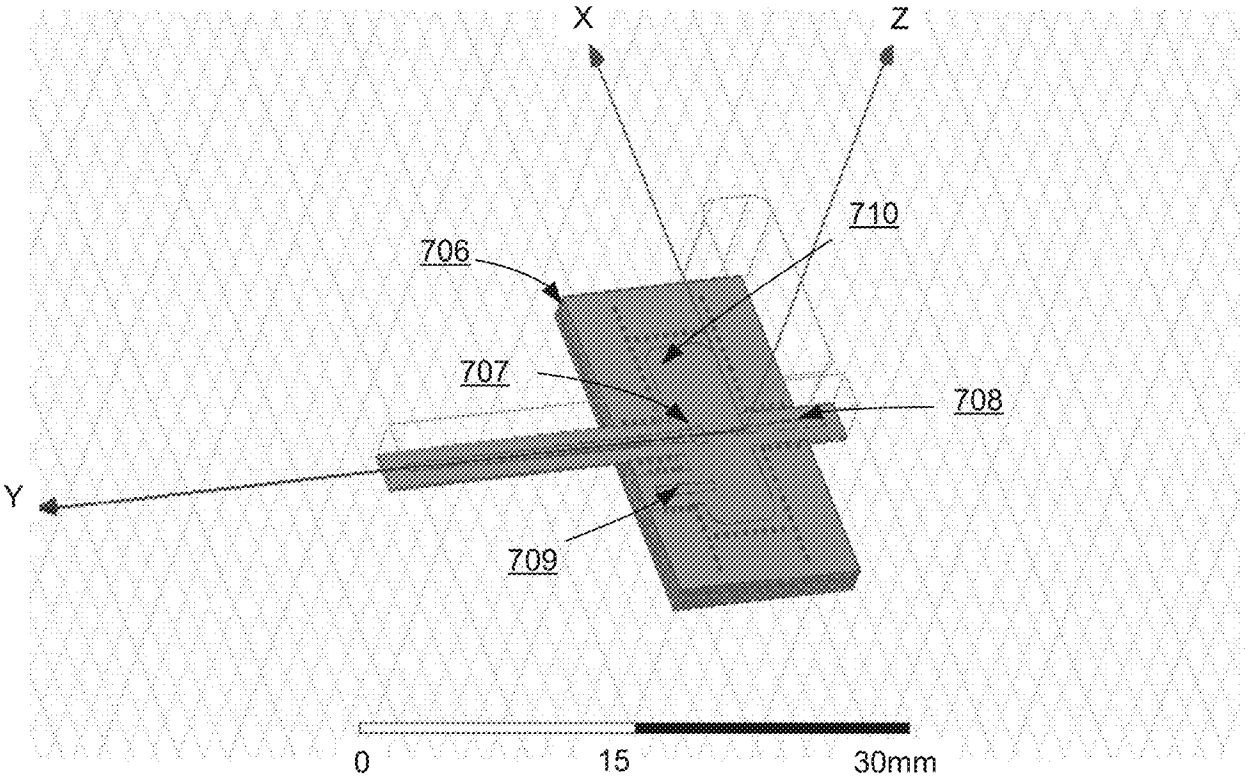
Figure 7C:
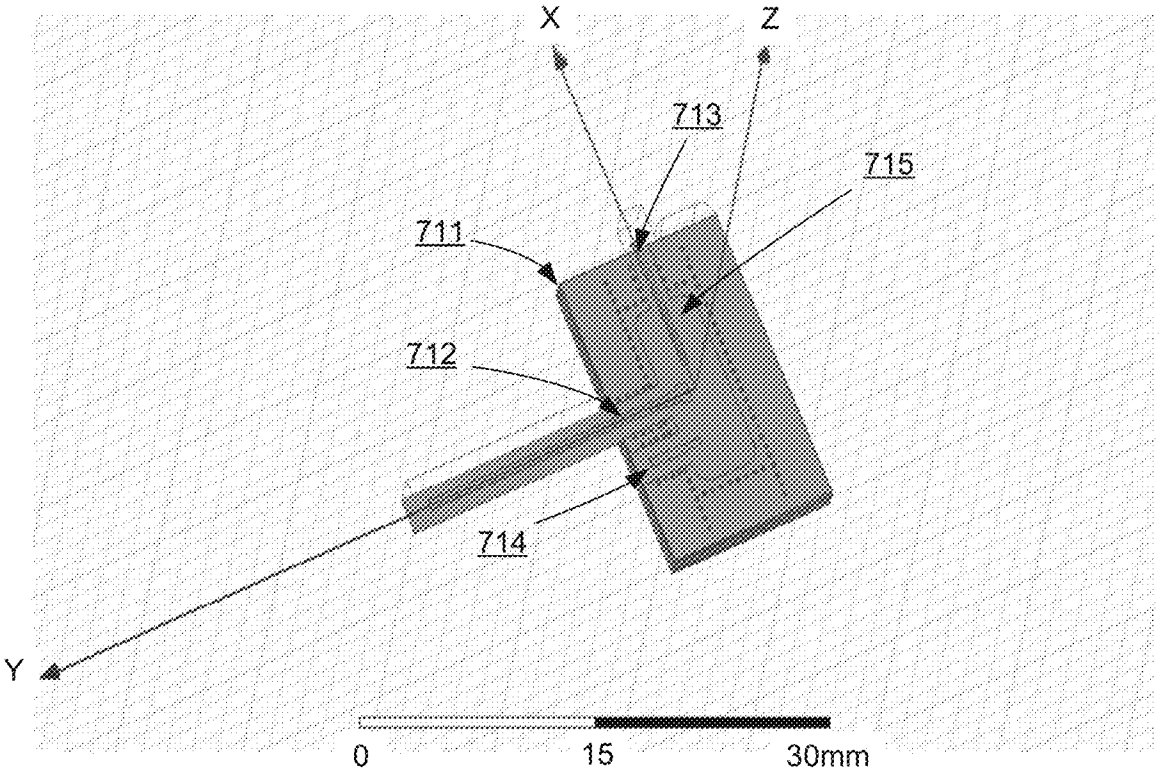
Figure 8:
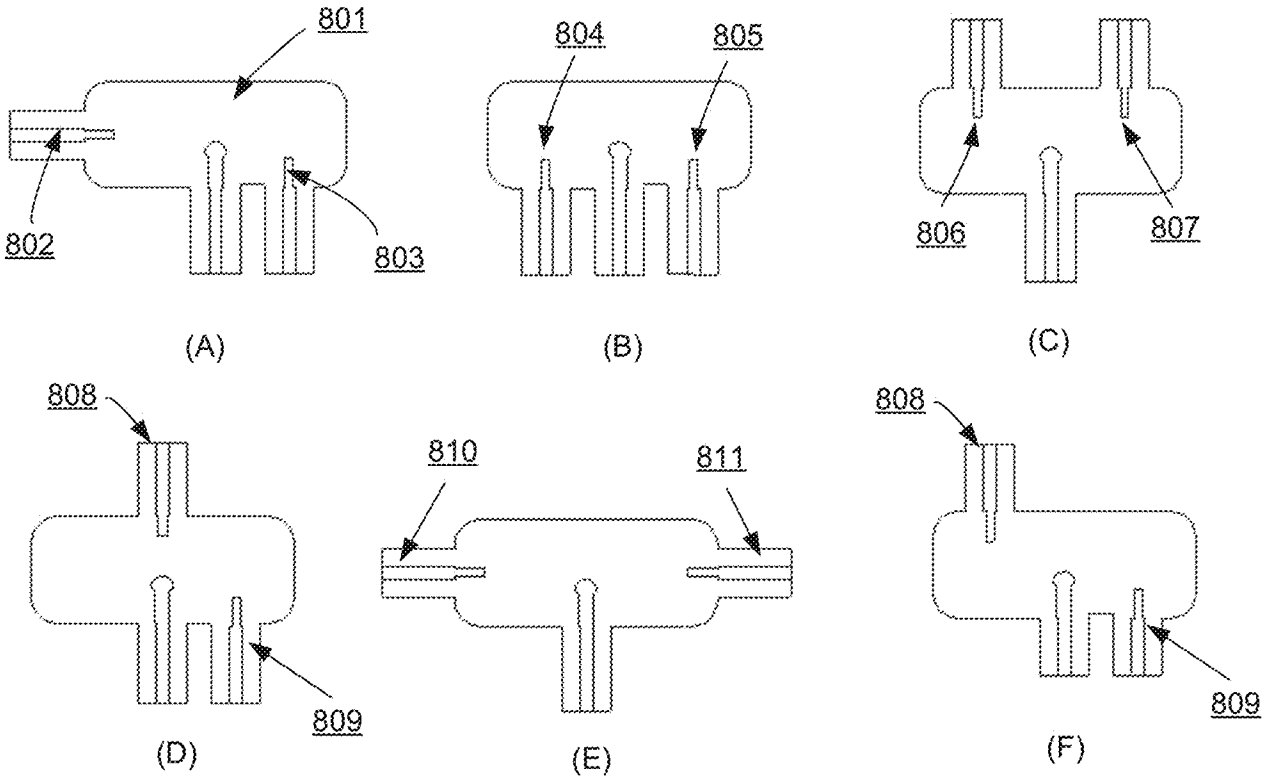
FIGS. 8A to 8F depicts an example of various coupling schemes in accordance with some embodiments of the present invention.

FIGS. 7A to 7C depict three examples of a compact microstrip to waveguide dual coupler in a 3-D coordinate system defined by (X,Y,Z) and an associated length scale in accordance with some embodiments of the present invention that include a transition probe and two coupler probes, where the transition probe is coupled to an internal space of the waveguide through an electric field, and the coupler probes are coupled to the internal of the waveguide through a magnetic field.

In the embodiment shown in FIG. 7A, a transition probe 702 is configured on the upper surface of PCB 701, where a terminal of the transition probe 702 extends into the rectangular region 705 through a long edge of the rectangular region 705. The other terminal of the transition probe 702 is electrically connected to a power amplifier (not shown in FIG. 7A). A first coupler probe 703 is configured on the upper surface of PCB 701, where a terminal of the first coupler probe 703 extends into the rectangular region 705 through a long edge of the rectangular region 705. A second coupler probe 704 is configured on the upper surface of PCB 701, where a terminal of the second coupler probe 704 extends into the rectangular region 705 through a short edge of the rectangular region 705.

In the embodiment shown in FIG. 7B, a transition probe 707 is configured on the upper surface of PCB 706, where a terminal of the transition probe 707 extends into the rectangular region 710 through a long edge of the rectangular region 710. The other terminal of the transition probe 707 is electrically connected to a power amplifier (not shown in FIG. 7B). A first coupler probe 708 is configured on the upper surface of PCB 706, where a terminal of the first coupler probe 708 extends into the rectangular region 710 through a long edge of the rectangular region 710. A second coupler probe 709 is configured on the upper surface of PCB 706, where a terminal of the second coupler probe 709 extends into the rectangular region 710 through a long edge of the rectangular region 710.

In the embodiment shown in FIG. 7C, a transition probe 712 is configured on the upper surface of PCB 711, where a terminal of the transition probe 712 extends into the rectangular region 715 through a long edge of the rectangular region 715. The other terminal of the transition probe 712 is electrically connected to a power amplifier (not shown in FIG. 7C). A first coupler probe 713 is configured on the upper surface of PCB 711, where a terminal of the first coupler probe 713 extends into the rectangular region 715 through a short edge of the rectangular region 715. A second coupler probe 714 is configured on the upper surface of PCB 711, where a terminal of the second coupler probe 714 extends into the rectangular region 715 through a long edge of the rectangular region 715.

FIGS. 8A to 8F depicts an example of various coupling schemes in accordance with some embodiments of the present invention. For example, in some embodiment shown in FIG. 8A, the first coupler probe 802 extends into the rectangular region 801 through a short edge of the rectangular region 801, and a second coupler probe 803 extends into the rectangular region 801 through the same long edge of the rectangular region 801 as the transition probe. In some embodiments shown in FIG. 8B, the first coupler probe 804 extends into the rectangular region through the same long edge of the rectangular region as the transition probe, and disposed at one side of the transition probe; and the second coupler probe 805 extends into the rectangular region through the same long edge of the rectangular region as the transition probe, and disposed at another side of the transition probe. In some embodiments shown in FIG. 8C, the first coupler probe 806 extends into the rectangular region through an opposite long edge of the rectangular region from the transition probe, and the second coupler probe 807 extends into the rectangular region through the opposite long edge of the rectangular region from the transition probe. In some embodiments shown in FIGS. 8D and 8F, the first coupler probe 808 extends into the rectangular region through an opposite long edge of the rectangular region from the transition probe; and the second coupler probe 809 extends into the rectangular region through the same long edge of the rectangular region as the transition probe. In some embodiments shown in FIG. 8E, the first coupler probe 810 extends into the rectangular region through a short edge of the rectangular region; and the second coupler probe 811 extends into the rectangular region through an opposite short edge of the rectangular region from the first coupler probe.

Figure 9:
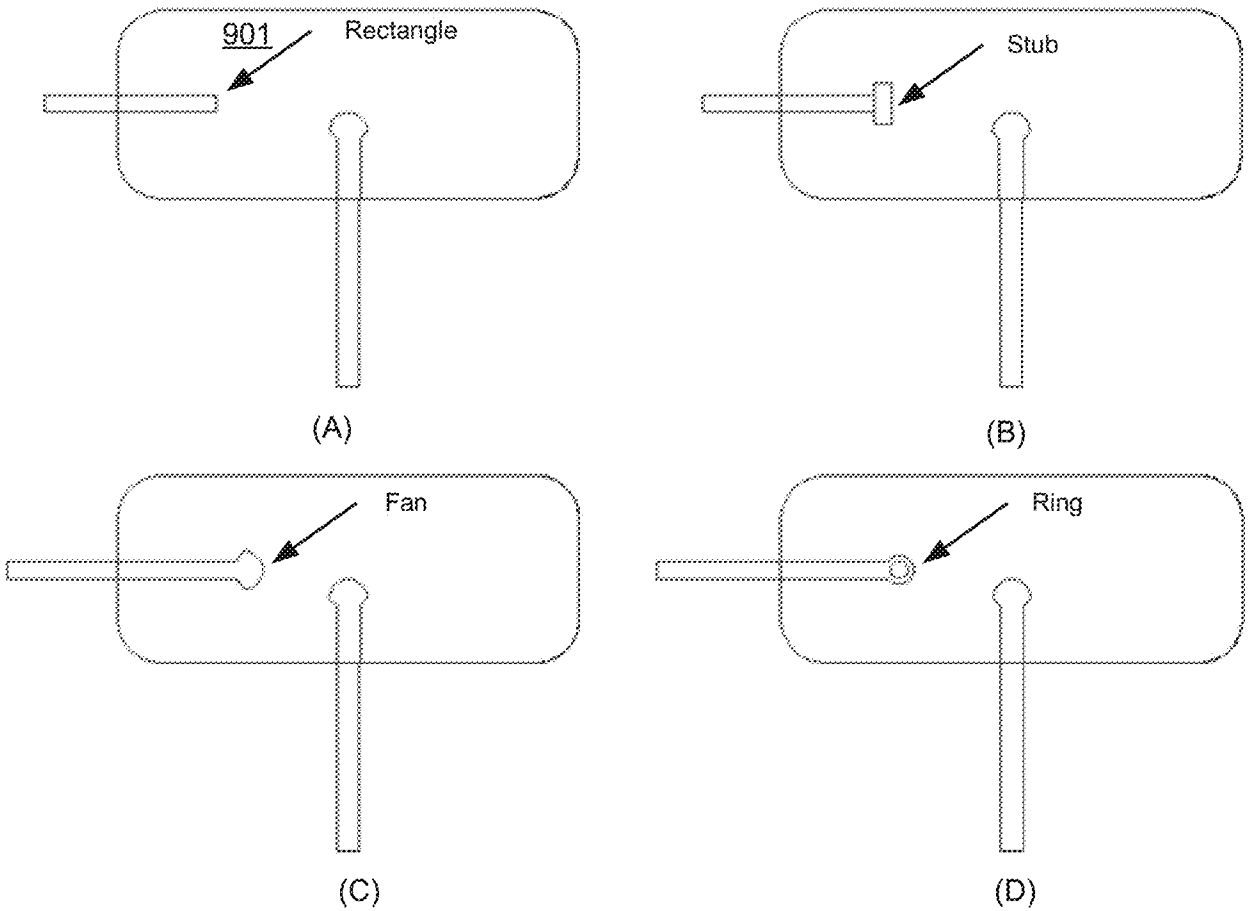
FIGS. 9A to 9D depict four coupler probe designs in accordance with some embodiments of the present invention.

FIG. 9A to 9D depict four coupler probe designs in accordance with some embodiments of the present invention. For example, the terminal of the coupler probe 901 (FIG. 9A) has a shape selected from the group consisting of rectangle (FIG. 9A), fan (FIG. 9C), ring (FIG. 9D), and stub (FIG 9B).

Figure 10:
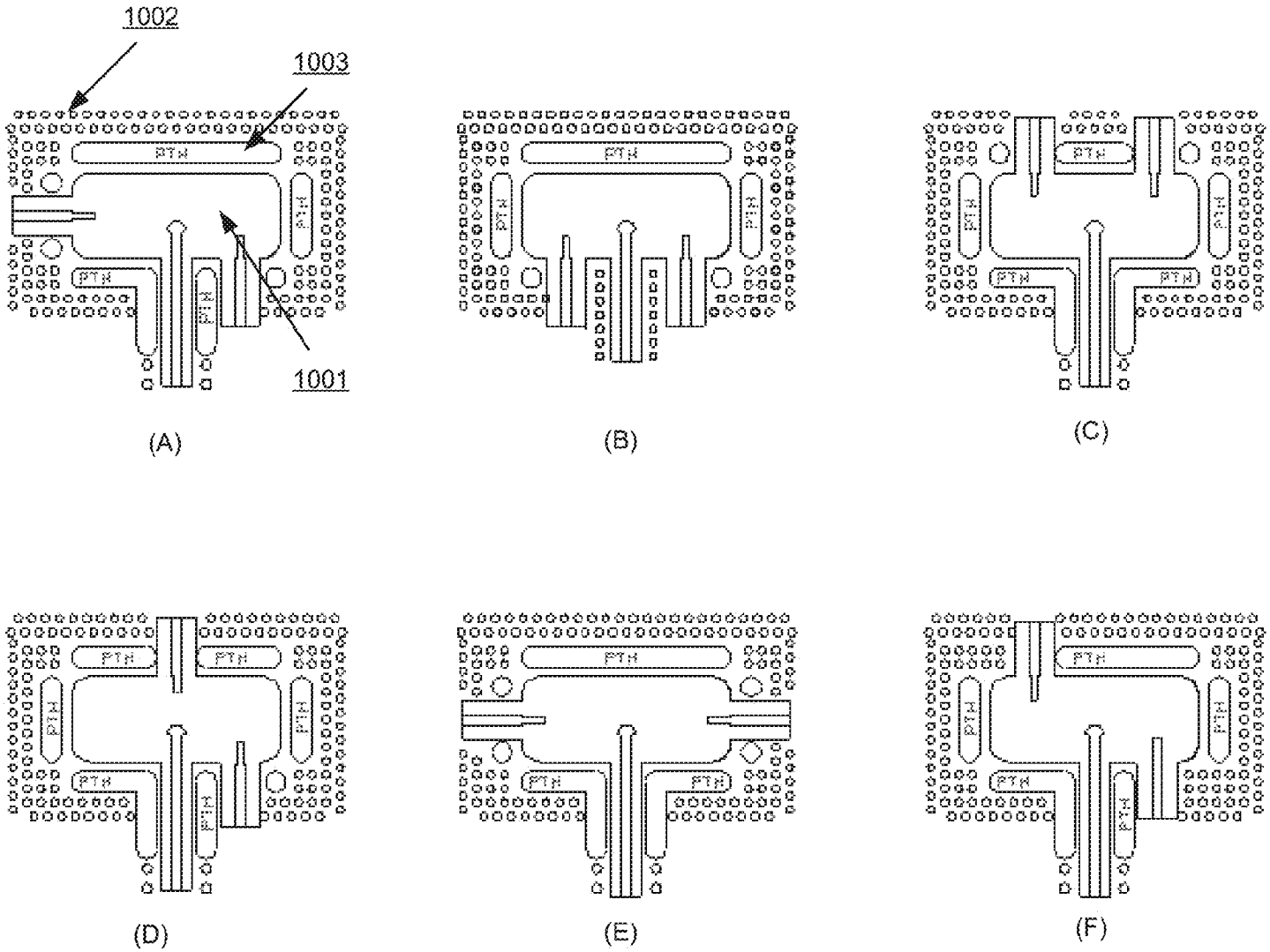
FIGS. 10A to 10F depict six metal-plated structures on a compact microstrip to waveguide dual coupler in accordance with some embodiments of the present invention.

FIG. 10 depicts various metal-plated structures on a compact microstrip to waveguide dual coupler in accordance with some embodiments of the present invention. In some embodiment, the rectangular region 1001 is surrounded by a plurality of metal-plated through-hole vias 1002 plated from the upper surface to the bottom surface through the multilayer PCB. In some embodiments, the rectangular region 1001 is further surrounded by a plurality of metal-plated slots (PTH) 1003 plated from the upper surface to the bottom surface through the multilayer PCB. In accordance with some embodiments, the metal-plated slots are disposed adjacent to the transition probe. In some embodiments, the metal-plated slots are disposed adjacent to the first coupler probe and/or the second coupler probe.

The plurality of metal-plated through-hole vias 1002 and metal-plated slots 1003 are electrically connected to a grounded metal layer on the bottom surface of the PCB to protect the transition probe and the coupler probes from being interfered by external noise or other factors. The large coverage of the metal-plated slots 1003 makes the metal-plated slots 1003 more effective than the metal-plated through-hole vias 1002 in protecting the probes in some embodiments. With the plated slots, the overall transition shows a better performance with minimum insertion loss.

Figure 11:
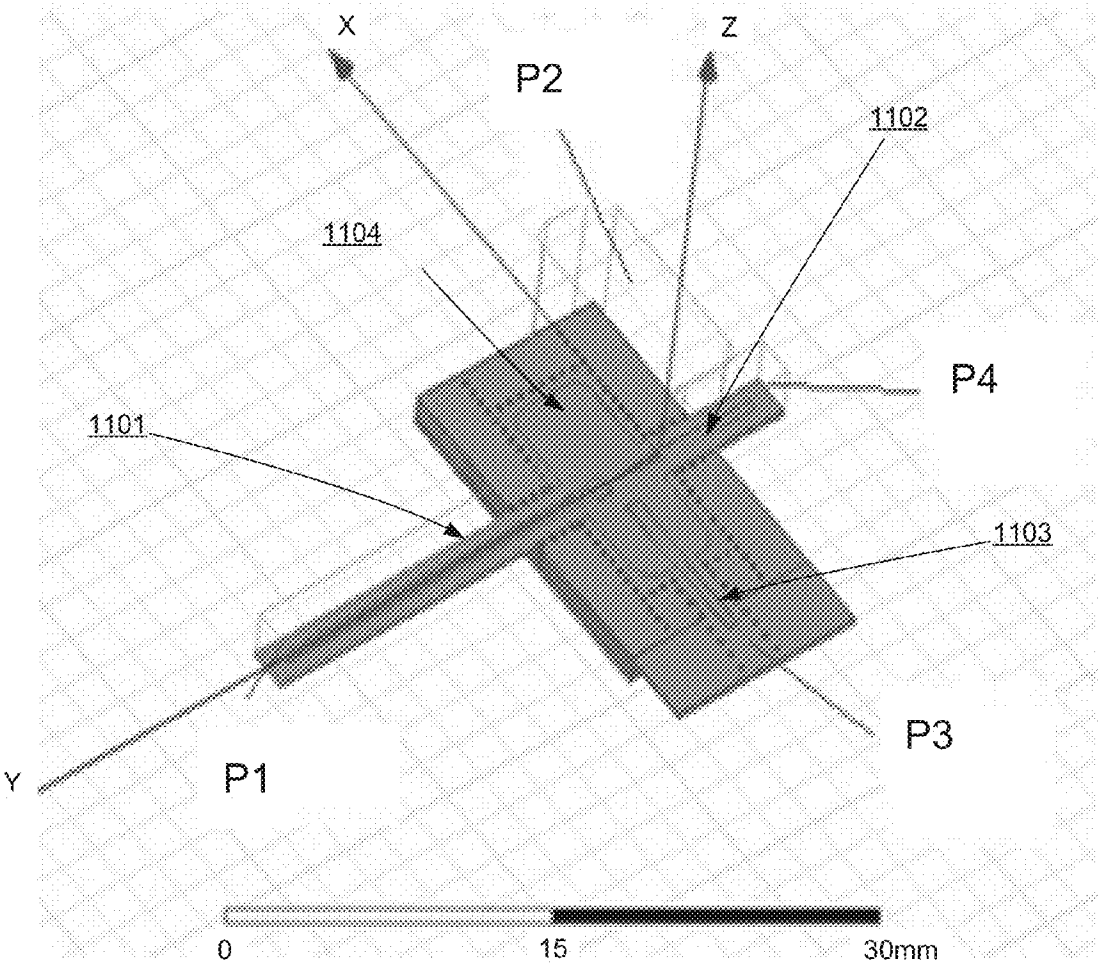
FIG. 11 depicts a compact microstrip to waveguide dual coupler in accordance with a first embodiment of the present invention.
Figure 12:
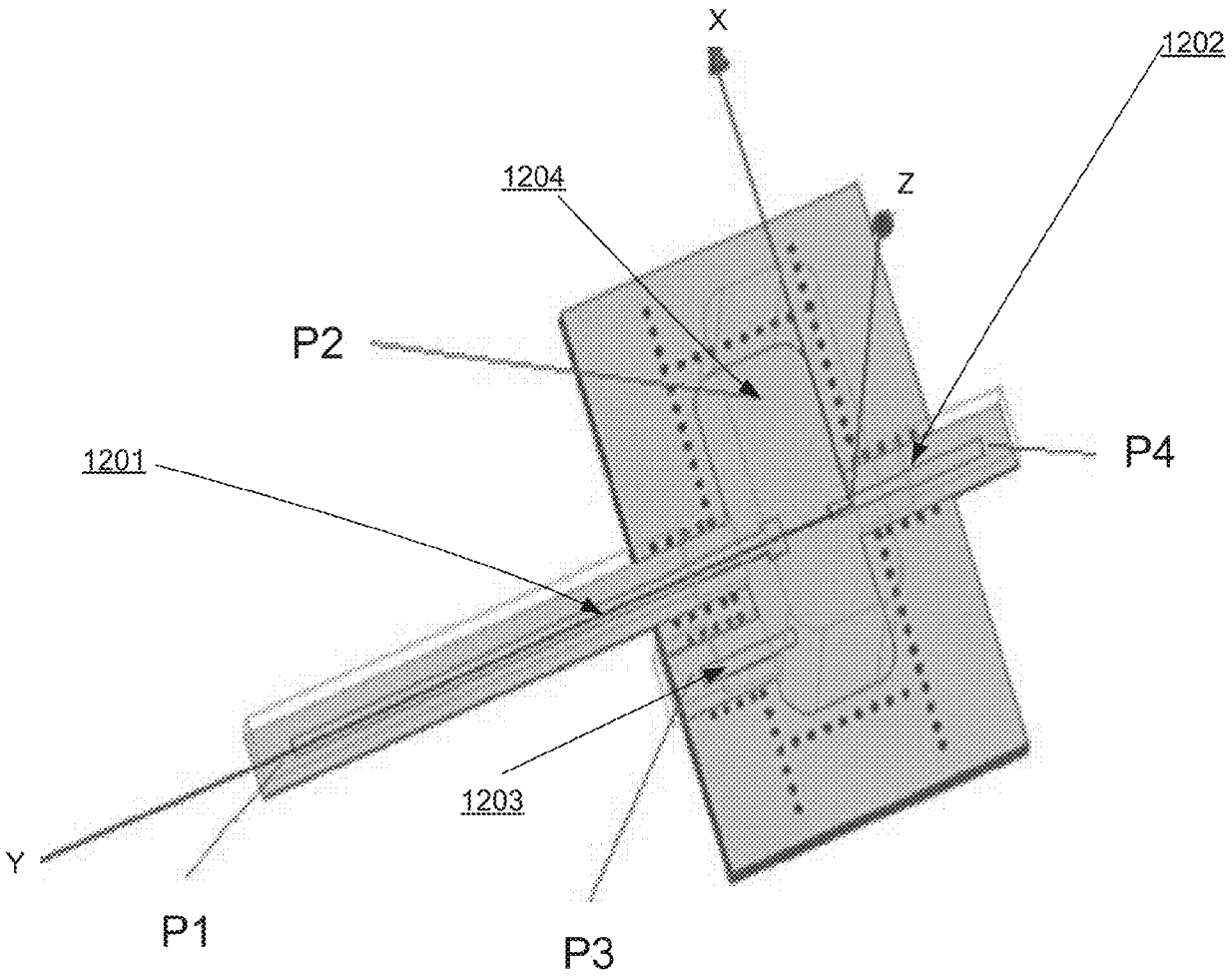
FIG. 12 depicts a compact microstrip to waveguide dual coupler in accordance with a second embodiment of the present invention.
Figure 13:
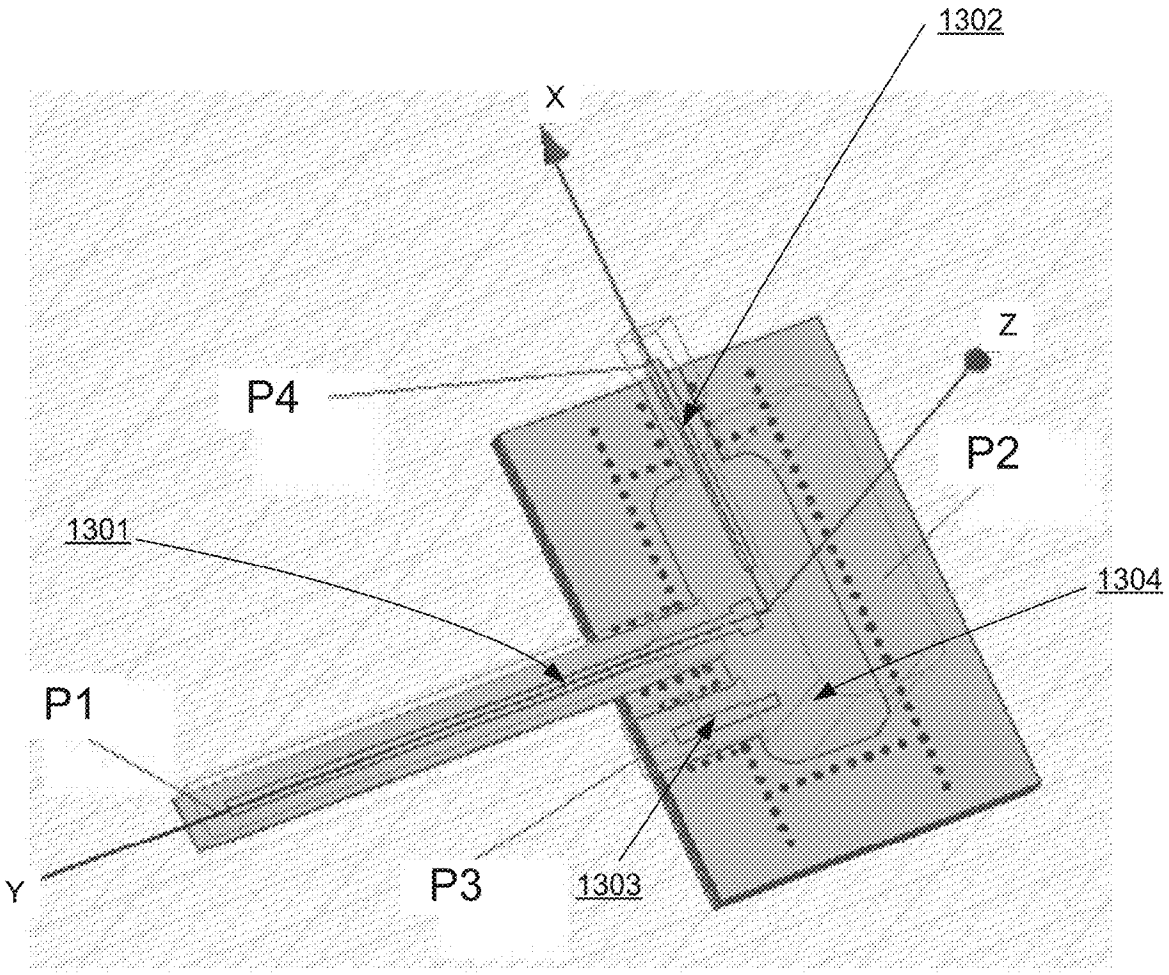
FIG. 13 depicts a compact microstrip to waveguide dual coupler in accordance with a third embodiment of the present invention.

FIGS. 11 to 13 depict three compact microstrip to waveguide dual couplers in a 3-D coordinate system defined by (X,Y,Z) and an associated length scale in accordance with some embodiments of the present invention.

In the embodiment shown in FIG. 11A, a transition probe 1101 extends into the rectangular region 1104 through a long edge of the rectangular region 1104, a first coupler probe 1102 extends into the rectangular region 1104 through the opposite long edge of the rectangular region 1104, and a second coupler probe 1103 extends into the rectangular region 1104 through a short edge of the rectangular region 1104, respectively. The RF input port P1 is aligned with the first coupler output port P4, the waveguide output port P2 is perpendicular to the plane defined by the rectangular region 1104, and the second coupler output port P3 is perpendicular to the RF input port 1.

In the embodiment shown in FIG. 12, a transition probe 1201 extends into the rectangular region 1204 through a long edge of the rectangular region 1204, a first coupler probe 1202 extends into the rectangular region 1204 through the opposite long edge of the rectangular region 1204, and a second coupler probe 1203 extends into the rectangular region 1204 through the same long edge of the rectangular region 1204 as the transition probe 1201, respectively. The RF input port P1 is aligned with the first coupler output port P4, the waveguide output port P2 is perpendicular to plane defined by the rectangular region 1204, and the second coupler output port P3 is parallel to but in the opposite direction of the RF input port P1.

In the embodiment shown in 13, a transition probe 1301 extends into the rectangular region 1304 through a long edge of the rectangular region 1304, the first coupler probe 1302 extends into the rectangular region 1304 through a short edge of the rectangular region 1304, and a second coupler probe 1303 extends into the rectangular region 1304 through the same long edge of the rectangular region 1304 as the transition probe 1301, respectively. The RF input port P1 is perpendicular to the first coupler output port P4, the waveguide output port P2 is perpendicular to the plane defined by the rectangular region 1304, and the second coupler output port P3 is parallel to but in the opposite direction of the RF input port P1.

The simulation measures system performance such as, return loss S11 at the RF input port P1, transition insertion loss S21 at the waveguide output port P2 in reference of the input port P1, return loss S22 at the waveguide output port P2, coupling factor S13 at the second coupler output port P3 in reference of the input port P1, and coupling factor S14 at the first coupler output port P4 in reference of the input port P1, respectively. Based on different system requirements on bandwidth, coupling factors and isolation factors, the structure of a compact microstrip to waveguide dual coupler including the coupler probe length, the coupler probe shape, and the coupler probe width can be optimized to meet the coupler design requirement.

By introducing the compact structure of microstrip to waveguide dual coupler, the microstrip to waveguide dual coupler demonstrates the following advantages over the conventional design:

- No separate coupler between the power amplifier and the transition, thus reducing the overall size of the transition device;
- No requirement for a perfect load of 50 Ohm for the coupler;
- Elimination of the negative impact caused by the parasitic parameters due to the high frequency PCB characteristics;
- Reduced insertion loss of the coupler and therefore improved output power and linearity due to overall low loss of the coupler; and Improved overall layout because of the integration of the coupler into the transition.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the invention and its practical applications, to thereby enable others skilled in the art to best utilize the invention and various embodiments with various modifications as are suited to the particular use contemplated.

We claim:

1. A compact microstrip to waveguide dual coupler transition, comprising:

a multilayer printed circuit board configured with a rectangular region on an upper surface of the multilayer printed circuit board, wherein the rectangular region has a pair of long edges and a pair of short edges;

a transition probe configured on the upper surface of the multilayer printed circuit board, wherein a terminal of the transition probe extends into the rectangular region through a long edge of the rectangular region, and another terminal of the transition probe is electrically connected to a power amplifier;

a first coupler probe configured on the upper surface of the multilayer printed circuit board, wherein a terminal of the first coupler probe extends into the rectangular region; and a second coupler probe configured on the upper surface of the multilayer printed circuit board, wherein a terminal of the second coupler probe extends into the rectangular region, wherein:

the first coupler probe extends into the rectangular region through the same long edge of the rectangular region as the transition probe, and disposed at one side of the transition probe; and the second coupler probe extends into the rectangular region through the same long edge of the rectangular region as the transition probe, and disposed at another side of the transition probe.

2. The compact microstrip to waveguide dual coupler transition of claim 1, wherein the rectangular region on the upper surface of the printed circuit board is devoid of a metal layer.

3. The compact microstrip to waveguide dual coupler transition of claim 2, wherein the rectangular region on the upper surface of the printed circuit board is surrounded by a metal region including a plurality of meta-plated through-hole vias plated extending from the upper surface to the bottom surface through the multilayer printed circuit board.

4. The compact microstrip to waveguide dual coupler transition of claim 2, wherein the rectangular region on the upper surface of the printed circuit board is surrounded by a metal region including a plurality of metal-plated slots plated extending from the upper surface to the bottom surface through the multilayer printed circuit board.

5. The compact microstrip to waveguide dual coupler transition of claim 4, wherein the metal-plated slots are disposed adjacent to the second coupler probe.

6. The compact microstrip to waveguide dual coupler transition of claim 4, wherein the metal-plated slots are disposed adjacent to the first coupler probe.

7. The compact microstrip to waveguide dual coupler transition of claim 4, wherein the metal-plated slots are disposed adjacent to the transition probe.

8. The compact microstrip to waveguide dual coupler transition of claim 1, wherein a waveguide is propagated through the rectangle region of the upper surface of the multilayer printed circuit board in a direction perpendicular to the upper surface of the multilayer printed circuit board.

9. The compact microstrip to waveguide dual coupler transition of claim 1, wherein an input radio frequency (RF) signal is inputted through the transition probe in a direction parallel to the upper surface of the multilayer printed circuit board.

10. The compact microstrip to waveguide dual coupler transition of claim 1, wherein a first output RF signal is outputted through the first coupler probe in a direction parallel to the upper surface of the multilayer printed circuit board, and a second output RF signal is outputted through the second coupler probe in a direction parallel to the upper surface of the multilayer printed circuit board.

11. The compact microstrip to waveguide dual coupler transition of claim 1, wherein a bottom surface of the multilayer printed circuit board is connected to a waveguide back short.

12. The compact microstrip to waveguide dual coupler transition of claim 1, wherein the terminal of the coupler probe has a shape selected from the group consisting of rectangle, fan, ring, and stub.

13. The compact microstrip to waveguide dual coupler transition of claim 12, wherein the terminal of the transition probe is coupled to an internal space of the waveguide through an electric field.

14. The compact microstrip to waveguide dual coupler transition of claim 12, wherein the terminal of the first coupler probe and the terminal of the second coupler probe are magnetically coupled to an internal space of the waveguide through a magnetic field.

* * * * *